US008296869B2

(12) United States Patent
Kellogg

(10) Patent No.: US 8,296,869 B2
(45) Date of Patent: Oct. 30, 2012

(54) APPARATUS FOR TEACHING BATTERS, AND METHOD

(75) Inventor: Michael Kellogg, Oak Grove, MO (US)

(73) Assignee: Head on the Ball, LLC, Oak Grove, MO (US)

( * ) Notice: Subject to any disclaimer, the term of this patent is extended or adjusted under 35 U.S.C. 154(b) by 373 days.

(21) Appl. No.: 11/810,312

(22) Filed: Jun. 6, 2007

(65) Prior Publication Data

US 2008/0000016 A1 Jan. 3, 2008

Related U.S. Application Data

(60) Provisional application No. 60/813,208, filed on Jun. 13, 2006.

(51) Int. Cl.

| | |
|---|---|
| ***A42B 1/08*** | (2006.01) |
| ***A42B 1/06*** | (2006.01) |
| ***A42B 1/00*** | (2006.01) |
| ***A63B 71/10*** | (2006.01) |
| ***A63B 69/00*** | (2006.01) |
| ***A61F 9/00*** | (2006.01) |

(52) U.S. Cl. ..... 2/424; 2/410; 2/425; 2/15; 2/9; 473/458

(58) Field of Classification Search ..... 2/410, 6.3, 2/411, 9, 422, 425, 15, 6.2, 6.4, 6.5, 6.7, 2/6.8, 8.1, 8.2, 8.3, 8.4, 8.5, 8.6, 8.7, 8.8, 2/12, 13, 427, 440, 209.12, 209.13, 175.2, 2/433, 449; D2/866, 876, 891, 893; D29/104, D29/105, 106, 107, 109, 110; 434/247, 248, 434/249, 250, 251, 252, 253, 254, 255, 257
See application file for complete search history.

(56) References Cited

U.S. PATENT DOCUMENTS

| | | | | | |
|---|---|---|---|---|---|
| 296,388 | A | * | 4/1884 | Choate et al. | 2/433 |
| 924,613 | A | * | 6/1909 | Hellawell | 2/9 |
| 1,199,162 | A | * | 9/1916 | Dickey et al. | 2/12 |
| 2,248,331 | A | * | 7/1941 | Blodjer | 2/10 |
| 2,418,376 | A | * | 4/1947 | Turner | 2/9 |
| 2,462,258 | A | * | 2/1949 | Dannenberg | 2/195.5 |
| 3,535,706 | A | * | 10/1970 | Aileo | 2/5 |
| 3,685,054 | A | * | 8/1972 | Raschke | 2/10 |
| 4,063,740 | A | * | 12/1977 | Mader | 473/210 |
| 4,392,650 | A | * | 7/1983 | Hilton | 473/464 |
| 4,479,738 | A | * | 10/1984 | Kubnick | 403/329 |
| 4,494,251 | A | * | 1/1985 | Ainsworth et al. | 2/425 |
| 4,605,226 | A | * | 8/1986 | Morrissey | 473/458 |
| 4,677,694 | A | | 7/1987 | Crow | |
| 4,837,862 | A | * | 6/1989 | Heil | 2/12 |
| 4,933,993 | A | * | 6/1990 | McClelland | 2/424 |
| 4,999,856 | A | * | 3/1991 | DuVall | 2/424 |
| 5,165,683 | A | * | 11/1992 | Beutler et al. | 473/228 |
| 5,477,565 | A | * | 12/1995 | Hunt, Jr. | 2/423 |
| 5,661,534 | A | * | 8/1997 | Gill | 351/41 |
| 5,661,849 | A | * | 9/1997 | Hicks | 2/9 |
| 5,966,744 | A | | 10/1999 | Smith | |
| 6,514,081 | B1 | * | 2/2003 | Mengoli | 434/252 |
| 6,708,339 | B1 | * | 3/2004 | Smith, Jr. | 2/9 |
| D509,030 | S | | 8/2005 | Udelhofen | |
| 7,631,365 | B1 | * | 12/2009 | Mahan | 2/6.7 |
| 2002/0174480 | A1 | * | 11/2002 | Lombard | 2/424 |
| 2004/0214147 | A1 | * | 10/2004 | Robinson | 434/247 |
| 2007/0250990 | A1 | * | 11/2007 | Brown et al. | 2/414 |
| 2007/0250992 | A1 | * | 11/2007 | Brown | 2/424 |

* cited by examiner

*Primary Examiner* — Shelley Self
*Assistant Examiner* — Jane Yoon
(74) *Attorney, Agent, or Firm* — David E Herron, II

(57) ABSTRACT

The disclosure presents an innovative apparatus for use in instructing hitters how to focus one's field of vision into a preselected angular field; the invention is also a method of providing this instruction. The apparatus includes a helmet and a shroud configured to engage the helmet. An elongate opening is formed on the shroud to restrict a wearer's field of vision to a preselected angle.

8 Claims, 4 Drawing Sheets

APPARATUS FOR TEACHING BATTERS, AND METHOD

BACKGROUND AND FIELD OF INVENTION

Hitting a baseball has been deemed to be the most difficult skill in all sports. Accordingly, numerous devices and drills have been developed over the years in order to master this difficult task. Developing sound fundamentals, of course, is a primary focus of trainers and coaches. Teaching a batter to remain visually focused on the approaching pitch is of primary and paramount importance in establishing proper technique for a batter.

A common problem encountered by many batters is the inability to keep one's head and eyes steady during the swing, which necessarily involves rhythmic and synchronous movement. The disclosed inventive apparatus and method provides a unique approach to teaching the fundamental importance of maintaining visual focus at all phases of a batter's swing.

SUMMARY OF THE INVENTION

The invention is an apparatus including a batting helmet, and a method of instructing a batter.

The Inventive Apparatus

The inventive apparatus includes a shroud having a first end attachable adjacent a first side of a batting helmet, and a second end attachable adjacent a second side of the helmet. The top edge of the attachment is configured to abut the bill of the batting helmet. Additionally, the shroud is formed of a substantially opaque material that obscures the vision of the wearer, but an elongate opening extends longitudinally along the shroud and generally parallel the bill of the helmet and positioned adjacent eyes of the wearer. The opening is formed to limit the wearer's field of vision to a preselected angular range.

Optionally, the lip may be formed on the bill of the helmet, and the attachment may include a grip formed on an upper edge of the shroud. In this embodiment, the grip and lip are cooperatively formed to engage and hold the attachment securely against the helmet.

In a preferred embodiment, the helmet and attachment are removably attachable to one another. In order to accomplish a removable attachment, the invention may include a first connector positioned adjacent the first side of the helmet, and a second connector positioned adjacent the second side of the helmet. Additionally, the invention may include a first mating connector positioned adjacent the first end of the shroud, and a second mating connector positioned adjacent the second end of the shroud. In this embodiment, the attachment is affixed to the helmet by engaging the first connector with the first mating connector, and the second connector within the second mating connector.

In another embodiment, the shroud may include a first portion depending from an upper edge; this first portion extends downwardly from the bill and generally orthogonal the bill. In this embodiment, the shroud will also include an angled portion positioned below the first portion, the angled portion extending toward a face of the wearer.

The Inventive Method

The invention is also a method of instructing a batter. The method will include the step of providing the batter with a batting helmet having a bill. Additionally, the method will require one to form an attachment having a shroud with a first end attachable adjacent a first side of the helmet, and a second end attachable adjacent a second side of the helmet. The top edge of the shroud abuts the bill; moreover, the top edge may have a gripping means that fits over the bill and may prevent unwanted relative movement of the shroud relative the helmet. The gripping means may be a lip, for example, or it may include a cooperatively formed ledge.

The method will also include the step of forming the shroud of a substantially opaque material that obscures the vision of the wearer, except through an elongate opening positioned on the shroud. The opening will extend longitudinally along the shroud and generally parallel the bill of the helmet and positioned adjacent eyes of the wearer. The shroud and opening are cooperatively formed to limit a field of vision of the wearer to a preselected angular range.

Moreover, the inventive method will include the step of swinging at a ball while the helmet and attachment are in a worn position.

Optionally, the inventive method may include the step of forming a lip on the bill, and positioning a grip on an upper edge of the shroud and cooperatively configuring the grip to engage the lip and hold the attachment securely against helmet. In this preferred embodiment of the method, the attachment and helmet are removably engageable with one another. However, the attachment and helmet may also be formed as a unitary monolithic one-piece structure.

In one embodiment of the inventive method, a first connector adjacent the first side of the helmet, and a second connector is adjacent the second side of the helmet. This embodiment will include the positioning of a first mating connector adjacent the first end of the shroud, and a second mating connector adjacent the second end of the shroud. The attachment is affixed to the helmet by engaging the first connector with the first mating connector, and engaging the second connector with the second mating connector.

Optionally, the shroud may include a first portion depending from an upper edge that depends generally orthogonally from the bill, and a second, angled portion positioned below the first portion, the angled portion extending toward the wearer's face.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
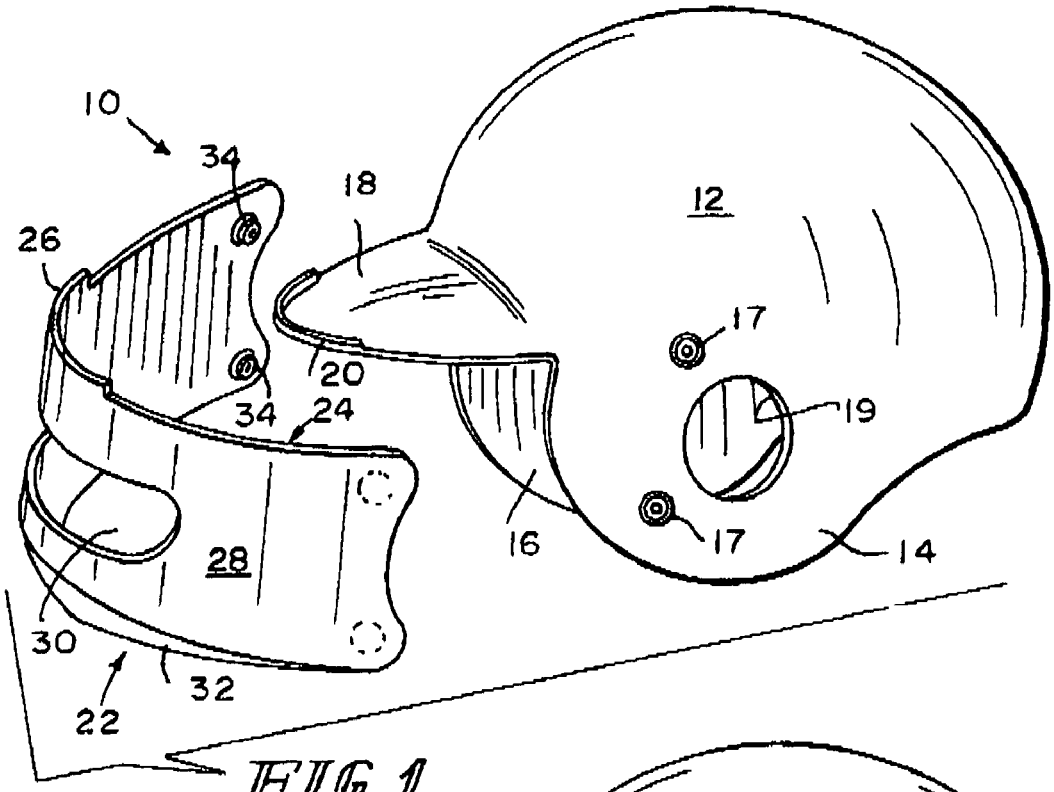
FIG. 1 is an exploded and perspective view of a first preferred embodiment of the apparatus, according to the principles of the invention.

FIG. 1 shows a perspective and exploded view of a first embodiment of the inventive apparatus 10. The apparatus 10 includes a helmet 12 having a forward-extending bill 18, a first side 14, and a generally symmetric and opposed second side 16. As typical with standard batting helmets, the helmet 12 may be equipped with standard connectors 17, such as snaps for example, positioned on each side 14, 16 adjacent an ear hole 19.

Still referring to FIG. 1, the apparatus 10 also includes a shroud 22 having an upper edge 24 that is configured to engage the bill 18 of the helmet 12. A grip may be positioned along the upper edge 24 of the shroud 22; this grip should be cooperatively configured to snugly and securely engage the bill 18. In order to increase the security of the attachment, the edge of the bill 18 may be equipped with a lip 20 that mates with the grip.

As shown in FIG. 1, the shroud 22 has a first portion 28 that is depends from the upper edge 24 in a direction generally orthogonal the bill 18; the shroud 22 may also include an angled portion 32 positioned adjacent a lower edge of the shroud 22. The angled portion 32 is angled with respect to the first portion 28 of the shroud 22, and points inward toward the wearer (not shown in FIG. 1, but viewable aft).

Still referring to FIG. 1, the shroud 22 may be attached to the helmet 12 by any known means of connection, such as hooks, buttons, or snaps. In that regard, connector(s) 17 may be placed on the outer portion of each side 14, 16 of the helmet 12, and configured to engage mating connectors 34 that are strategically placed on the shroud 22.

As shown in FIG. 1, the shroud 22 will include an elongate opening 30 formed on the first portion 28 of the shroud. The opening 30 should be wide enough to enable a batter to peer through the shroud 22, but its length should be limited in order to restrict the angular field of vision of the wearer. This restriction and limitation will compel the wearer to focus only on an approaching baseball, and will train a batter to keep one's head steady and eyes focused within the limited angular field. This restriction will deter the common bad habit of "pulling one's head" as the ball approaches.

Figure 2:
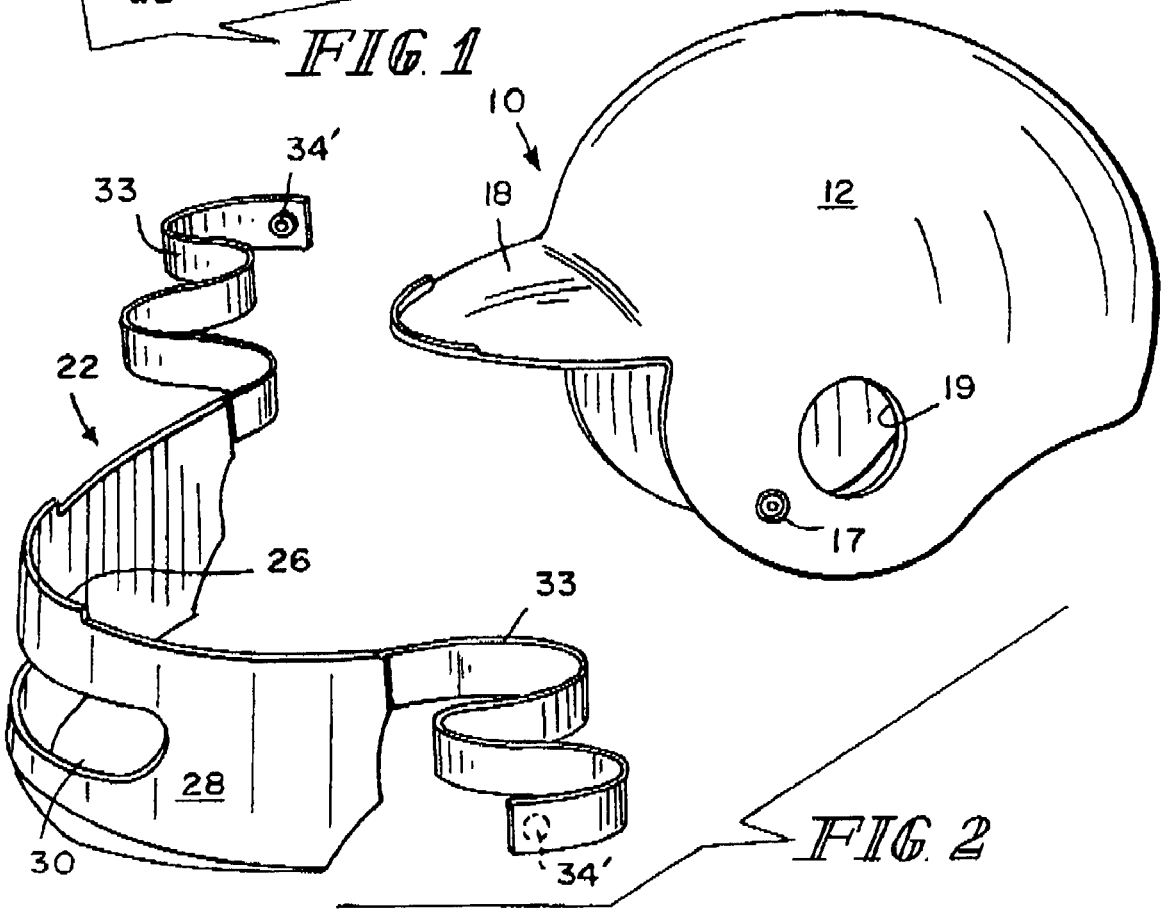
FIG. 2 is an exploded and perspective view of a second embodiment of the apparatus, according to the principles of the invention.

FIG. 2 shows a second preferred embodiment of the apparatus 10. Most of the parts of this embodiment are identical and/or analogous to the first embodiment of the apparatus 10, shown above. For the sake of simplicity, analogous parts are given the same reference number.

Still referring to FIG. 2, the apparatus 10 includes a helmet 12 having a forward-extending bill 18. The apparatus 10 also includes a generally opaque shroud 22 having an opening 30 formed to restrict the wearer's angular field of vision. A pair of connecting straps 33 are positioned adjacent the first and second ends of the shroud 22. These straps 33 assist in keeping the removably connected shroud 22 in engagement with the helmet 12.

The embodiment of the apparatus 10 shown in FIG. 2 may be held together by any known means. For example, the straps 33 may extend behind the wearer's neck and engage one another. Additionally, the strap 33 from the first side of the shroud 22 may wrap around the helmet 12 or the wearer's head and engage the connector 17 on the opposing side of the helmet 12. In yet another embodiment, the shroud 22 may be held in place by looping the strap 33 tautly through the ear hole 19 in the helmet, then snapping the terminus of the strap 33 to the connector 17 formed on the exterior of the helmet 12. In yet another variation, if the helmet 12 lacks a connector 17, the shroud 22 may be attached to the helmet 12 by looping the strap 33 through the ear hole 19 of the helmet and lightly knotting the strap 33 so that it holds the shroud 22 in place.

The embodiment shown in FIG. 2 will have a ledge 26 extending from an upper edge of the shroud 22; the ledge 26 is configured to engage the bill 18 when the shroud 22 is in the attached position. In that regard, the ledge 26 should be cooperatively shaped with the bill 18 so that, when attached to the helmet 12, the ledge 26 form-fits over the top of the bill 18 to prevent unwanted movement.

Figure 3:
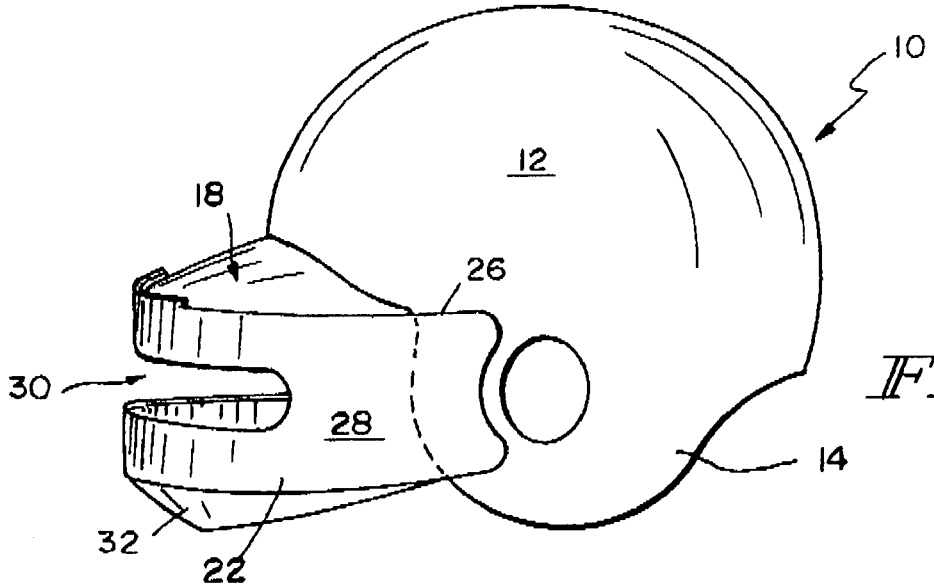
FIG. 3 is a perspective view of another embodiment the inventive apparatus, shown with the shroud engaged with the batting helmet.

FIG. 3 is a perspective view showing another embodiment of the inventive system 10 in the assembled condition. In this embodiment, the ledge 26 extends from the upper edge of the shroud 22 to engage the bill 18 of the helmet 12, preferably leaving no space therebetween. The shroud 22 is held in place by connectors and mating connectors that are formed on the helmet 12 and shroud 22 respectively. Additionally, unwanted movement of the shroud 22 is restricted by the ledge 26 that form-fits to the shape of the bill 18 on the helmet 12.

Figure 4:
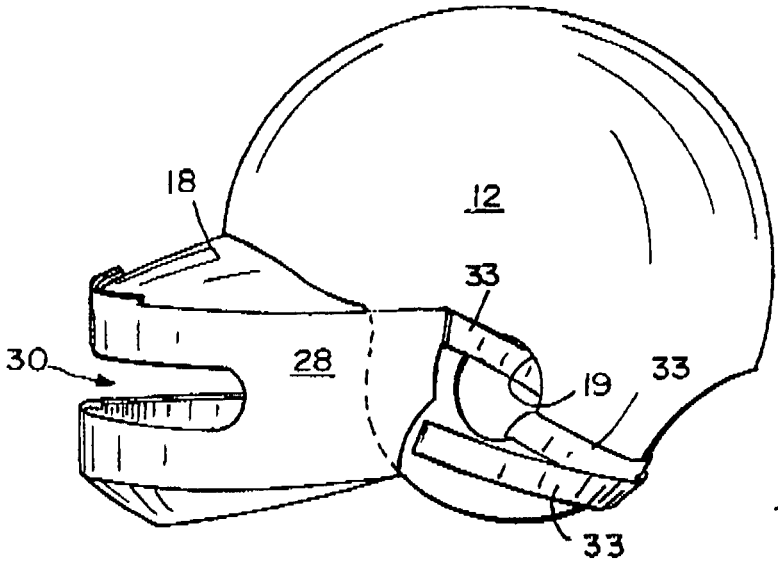
FIG. 4 is a perspective view showing another embodiment of the inventive apparatus with the shroud engaged with the batting helmet.

In an alternate embodiment of the apparatus 10, the shroud 22 and helmet 12 may be formed as a unitary, monolithic, one-piece structure. As shown in FIG. 4, the shroud 22 may be equipped with ear holes that substantially match the ear holes on the side 14 of the helmet 12. Alternatively, the ear holes on the shroud may form fit into these matching structures on the helmet 12.

FIG. 4 shows a perspective view of a second preferred embodiment of the inventive system 10, shown in the assembled condition. As with the previously-detailed embodiment, the shroud 22 abuts the bill 18 of the helmet 12. In this embodiment, a strap 22 is positioned adjacent the end of the shroud 22. The shroud 22 is held in place by looping the strap 33 through the ear hole 19 of the helmet 12, then engaging a mating connector on the strap 33 with the connector (i.e., a snap) on the helmet 12. If the helmet 12 lacks a connector, the strap 33 may be looped and tied to keep the shroud 22 firmly engaged against the helmet 12. Additionally, the strap 33 itself may be equipped with primary and secondary connectors that mate with one another.

Figure 5:
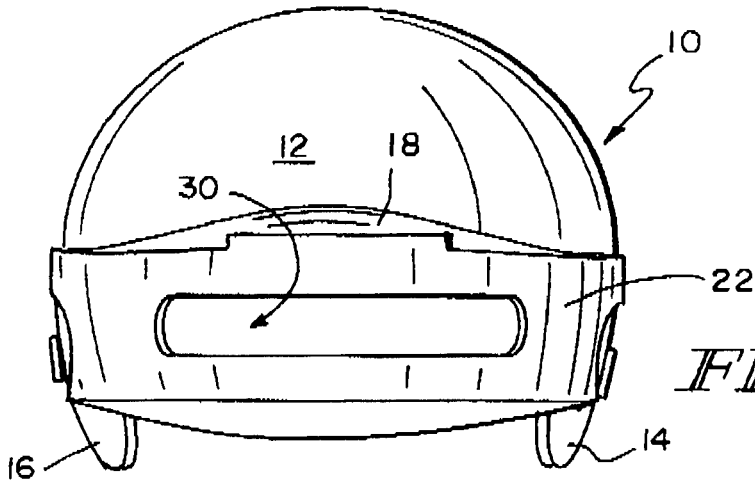
FIG. 5 shows a front view of the apparatus, shown with the shroud engaged onto the helmet.

FIG. 5 shows a frontal view of the apparatus 10 in its assembled condition. Note that the shroud 22 engages beneath the bill 18 of the helmet 12 in a substantially sealed engagement. An elongate opening 30 extends across a portion of the shroud 22. It is important to note that the elongate opening 30 does not traverse the entire length of the bill 18; rather, the opening 30 is formed to restrict the angular field of vision of the wearer, requiring her to focus on objects immediately before her instead of objects in her peripheral vision.

Figure 6:
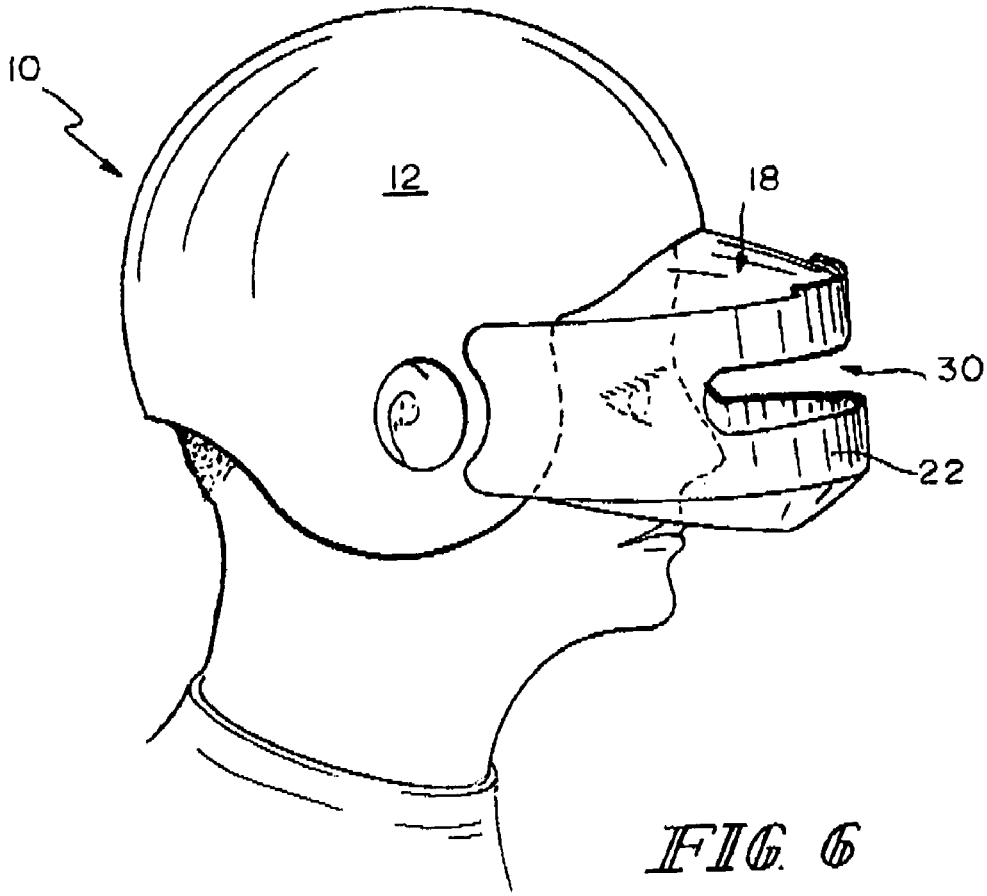
FIG. 6 shows a side view of the apparatus, as worn by a batter.

FIG. 6 is a side perspective view of the apparatus 10, shown as worn by a batter. As depicted before, the bill 18 of the helmet 12 engages the shroud 22 at a common edge, and the opening 30 is generally centered about the eyes of the wearer. Note that the opening 30 is shaped so that the wearer can see objects directly before her, but the side of the shroud 22 restricts the wearer's peripheral view. This configuration of the shroud 22 and opening trains the batter to 'center' one's vision upon the ball, and specifically prohibits the formation of a common bad habit, wherein the batter pulls her head off the ball, then attempts to rely on peripheral vision in order to see the ball strike the bat.

Figure 7:
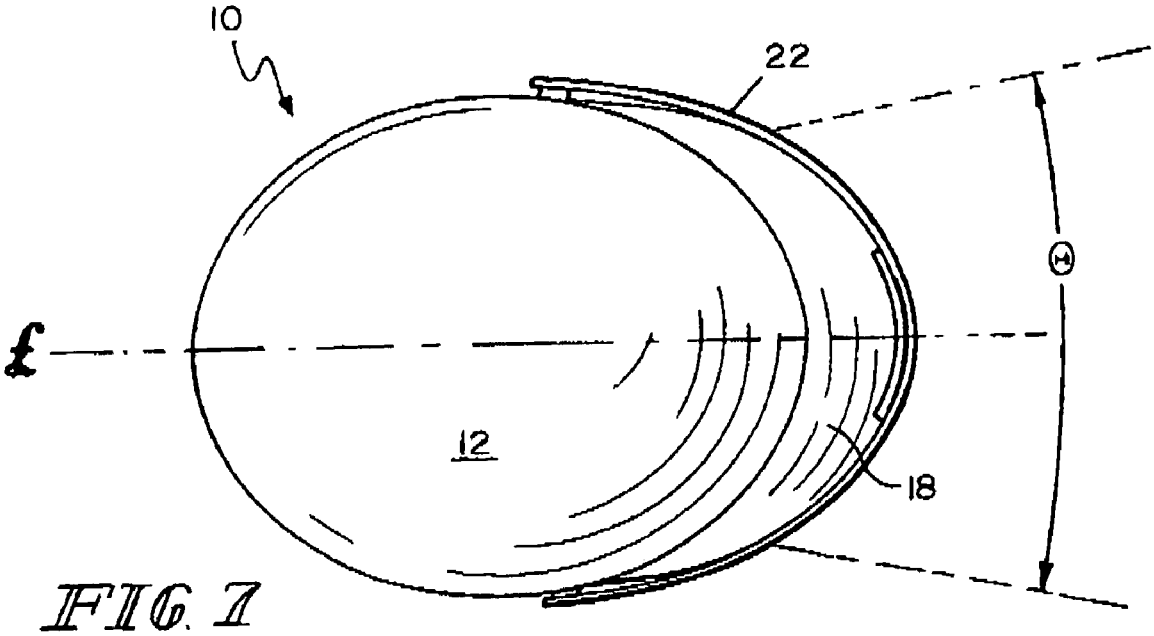
FIG. 7 is an overhead, plan view of the apparatus.

FIG. 7 is a plan view of the apparatus 10, shown as from above the helmet 12. In this view, the shroud 22 cannot be seen because it is overshadowed by the bill 18 of the helmet 12. The opening 30 in the shroud 22 (viewable above) restricts the batter's angular field of vision to a preselected angle Θ about the line of symmetry £ of the apparatus 10.

Figure 8:
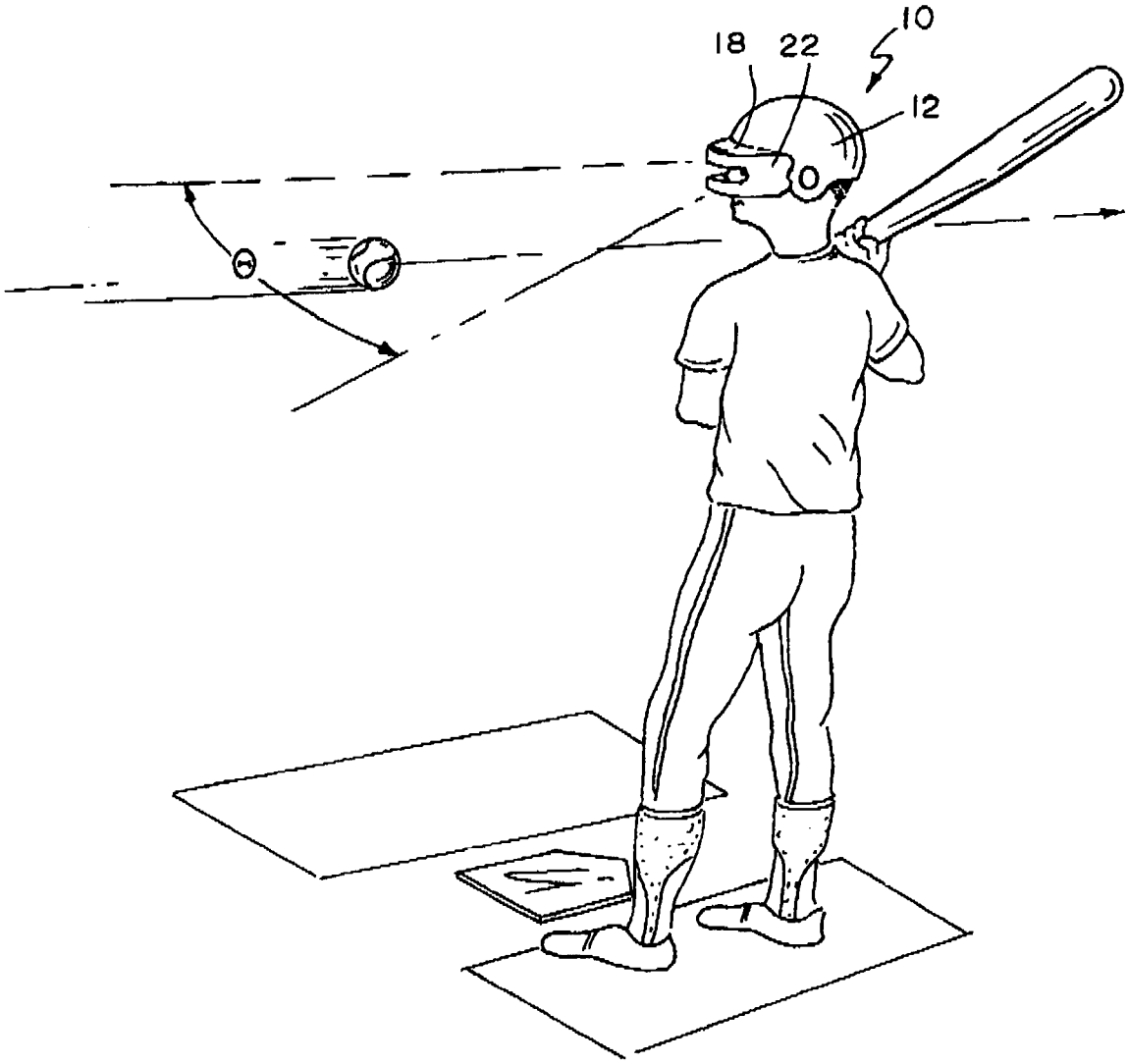
FIG. 8 shows a perspective view of the apparatus in use during a batting drill.

FIG. 8 shows the apparatus 10 in use during a batting drill. The bill 18 and shroud 22 cooperate to restrict the batter's angular field of vision to preselected angle Θ, thereby training the batter to focus upon a limited area, and specifically the approaching ball.

Although the present invention has been described and illustrated in detail, it is to be clearly understood that the same is by way of illustration and example only, and is not to be taken by way of limitation. The spirit and scope of the present invention are to be limited only by claims that will precisely define the metes and bounds of the invention.

I claim:

1. An apparatus adapted to be used with a batting helmet, the apparatus comprising a shroud formed of a substantially opaque material and having a first end attachable adjacent a first side of the helmet, and a second end attachable adjacent a second side of the helmet, and an upper wall extending from the first end to the second end, the upper wall having a width defined by a distance between a top edge configured to engage a bill of the helmet and a bottom edge that terminates in an elongate opening having a length that extends longitudinally along the shroud and generally parallel the top edge and positioned adjacent eyes of the wearer and a width that is substantially congruent to the width of the upper wall, the shroud having a first portion depending from the top edge, the first portion configured to extend downwardly from the bill and generally orthogonal the bill; and, an angled portion positioned below the first portion, the angled portion extending toward a wearer; and a ledge extending from the top edge of the shroud and cooperatively configured to bear a substantially similar contour as the bill, thereby enabling the ledge to form-fit onto the bill when the shroud is positioned to engage the helmet; wherein, the shroud and opening are cooperatively formed to limit the field of vision of the wearer to a preselected range that is perceptible through the opening in the shroud.

2. The apparatus as in claim 1, wherein the shroud is removably attachable to the helmet.

3. The apparatus as in claim 1, further comprising a first connector positioned adjacent the first side of the helmet;

a second connector positioned adjacent the second side of the helmet;

a first mating connector positioned adjacent the first end of the shroud; and, a second mating connector positioned adjacent the second end of the shroud; wherein, the shroud is affixed to the helmet by engaging the first connector with the first mating connector, and the second connector within the second mating connector.

4. A method of instructing a batter including the steps of:

providing the batter with a batting helmet having a bill;

cooperatively forming an apparatus to include a shroud having a first end attachable adjacent a first side of the helmet, and a second end attachable adjacent a second side of the helmet, and an upper wall having a top edge configured to engage the bill and a lower edge spaced downwardly from the top edge by a width of the upper wall;

forming the shroud of a substantially opaque material that substantially limits a field of vision of the wearer when the shroud engages the bill, the shroud having a first portion depending from the top edge, the first portion configured to extend downwardly from the bill and generally orthogonal the bill; an angled portion positioned below the first portion, the angled portion extending toward a wearer; and an elongate opening having a length extending longitudinally along the shroud and generally parallel the bill and a width generally perpendicular the bill of the helmet, the opening positioned adjacent eyes of the wearer, such that the shroud and opening are cooperatively formed to limit the field of vision of the wearer to a preselected range through the opening in the shroud;

forming the width of the opening to be substantially congruent the width of the upper wall; positioning a grip on the top edge of the shroud and cooperatively configuring the grip to engage the bill and hold the apparatus securely against the helmet, wherein the grip is a ledge formed to match a curvature of the bill such that the ledge is formed to fit snugly over the bill when the shroud is attached securely to the helmet;

and, observing the hatter swing at a ball while the helmet and apparatus are in a worn position.

5. The method as in claim 4, wherein the shroud is removably attachable to the helmet.

6. The method as in claim 4, further comprising the steps of positioning a first connector adjacent the first side of the helmet;

positioning a second connector adjacent the second side of the helmet;

positioning a first mating connector adjacent the first end of the shroud; and, positioning a second mating connector adjacent the second end of the shroud; and, affixing the apparatus to the helmet by engaging the first connector with the first mating connector, and engaging the second connector within the second mating connector.

7. The method as in claim 4, further comprising the step of wearing the helmet with the apparatus affixed, and swinging at a ball.

8. An apparatus adapted to be used with a batting helmet that includes a forward-extending bill and ear-holes formed in its sides, the apparatus comprising a shroud formed of a substantially opaque material and having a first end removably attachable adjacent a first side of the helmet, and a second end removably attachable adjacent a second side of the helmet, and an upper wall having a width defined by a distance between a top edge configured to engage a bill of the helmet and a bottom edge; the shroud also having a first portion depending from the top edge, the first portion configured to extend downwardly from the bill and generally orthogonal the bill; and an angled portion positioned below the first portion, the angled portion extending toward a wearer;

an elongate opening having a length extending generally parallel the top edge and a width generally orthogonal the top edge, the opening positioned adjacent eyes of the wearer; wherein, the width of the opening is substantially congruent to the width of the upper wall;

a first connector positioned adjacent the first side of the helmet;

a second connector positioned adjacent the second side of the helmet;

a first mating connector positioned adjacent the first end of the shroud; and, a second mating connector positioned adjacent the second end of the shroud;

wherein the shroud is affixed to the helmet by engaging the first connector with the first mating connector, and the second connector within the second mating connector; and, a ledge extending from the top edge of the shroud and cooperatively configured to bear a substantially similar contour as the bill, thereby enabling the ledge to form-fit onto the bill when the shroud is positioned to engage the helmet.

* * * * *